United States Patent [19]

Willer et al.

[11] Patent Number: 5,071,495

[45] Date of Patent: Dec. 10, 1991

[54] DIAMINOGLYOXIME AND DIAMINOFURAZAN IN PROPELLANTS BASED ON AMMONIUM PERCHLORATE

[75] Inventors: Rodney L. Willer; Minn-Shong Chi, both of Newark; Robert Gleeson, Bear, all of Del.; John C. Hill, Mesa, Ariz.

[73] Assignee: Thiokol Corporation, Ogden, Utah

[21] Appl. No.: 537,658

[22] Filed: Jun. 14, 1990

[51] Int. Cl.[5] ..... C06B 45/10

[52] U.S. Cl. ..... 149/19.9; 149/42; 149/76

[58] Field of Search ..... 149/19.9, 42, 76

[56] References Cited

U.S. PATENT DOCUMENTS 4,503,229 3/1985 Willer ..... 149/92

*Primary Examiner*—Stephen J. Lechert, Jr.

*Attorney, Agent, or Firm*—Lawrence I. Field; Ronald L. Lyons

[57] ABSTRACT

Solid propellants in which the oxidizer is a perchlorate are improved by the inclusion of diaminoglyoxime or diaminofurazan in the propellant compositions.

10 Claims, 5 Drawing Sheets

DIAMINOGLYOXIME AND DIAMINOFURAZAN IN PROPELLANTS BASED ON AMMONIUM PERCHLORATE

This invention relates to improvements in solid propellants in which the principal and usually the sole oxidizing agent is ammonium perchlorate (AP).

One of the disadvantages of many known propellant formulations based on AP is that the flame temperature is in excess of that desired for the production of optimum ballistic properties.

One previously suggested approach to lower flame temperature was the inclusion of a high nitrogen content coolant in ammonium perchlorate based propellant compositions, e.g. as described in U.S. Pat. No. 3,214,304, issued Oct. 26, 1965; U.S. Pat. No. 3,362,859, issued Jan. 9, 1968 and U.S. Pat. No. 3,960,946, issued June 1, 1976, the disclosures of which are incorporated herein by this reference.

In the present invention either diaminoglyoxime(-DAG) or diaminofurazan(DAF) is used in place of other previously employed high nitrogen content coolants such as dihydroglyoxime(DHG) and as a consequence, ballistic properties are improved. The incorporation of these additives in propellant compositions in which metallic Al or other free metals are present as a fuel has also been found to produce compositions with unique properties.

One object of the invention is to provide solid propellants based on ammonium perchlorate having improved ballistic properties.

A more specific object of the invention is to provide solid propellants containing a high percentage of solids and which exhibit excellent ballistic properties.

A further object is to provide propellant compositions containing DAG or DAF and having lower burn rates than otherwise similar compositions in which DHG is present.

A further object is to provide propellant compositions having negative exponents and low $\pi_K$ values.

Still a further object is to provide propellant compositions which facilitate the optimization of the dead weight in rocket motor design and which improve the mass fraction in rocket motor designs.

A further object is to provide propellant compositions which are compatible with isocyanate curing agents.

A further object is to provide free metal containing propellant compositions with enhanced ballistic properties.

These and other objects will become apparent from the description which follows taken in conjunction with the drawings in which.

Figure 1:
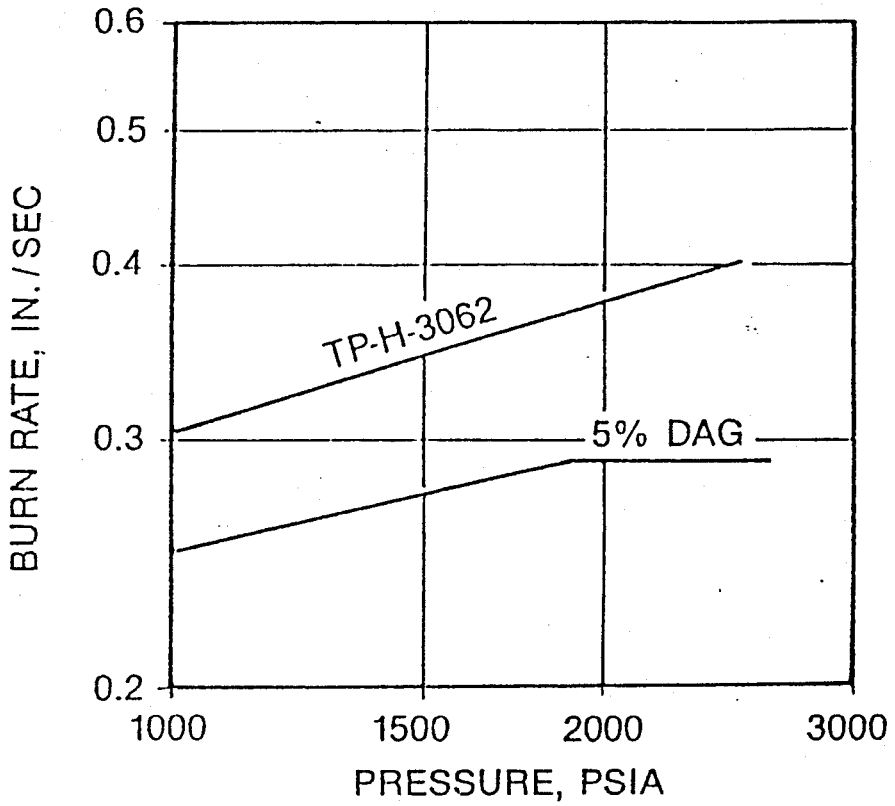
FIG. 1 is a graph showing burn rate vs pressure for an AP propellant composition containing DAG.

In general the solid ammonium perchlorate (AP) propellants to which the present invention is applicable comprise mixtures of the following, as described in the above noted patents:

1. Oxidizer
2. Coolant
3. Moderator—Oxamide
4. Fuel
5. Binder
6. Other ingredients

OXIDIZER

The preferred oxidizer is ammonium perchlorate which is known to produce flame temperatures above 4000° F. (see U.S. Pat. No. 3,214,304), but other perchlorates including alkali metal perchlorates and alkaline earth perchlorates may be used either with or in place of ammonium perchlorate. Preferably the solid propellant compositions of this invention contains up to as much as about 88% by weight of perchlorate oxidizer. The perchlorate is a coarse power, preferably a mixture of 400 and 20 particles. In general the larger the AP particle size, the lower the burn rate.

COOLANT

To lower the flame temperature produced by the perchlorate oxidizer and to improve the ballistic properties, a coolant is included in the propellant compositions, of this invention. As described in the above noted patents dihydroxyglyoxime (DHG) was one such coolant which has been previously used. In the present invention diaminoglyoxime (DAG) or diaminofurazan (DAF) or mixtures of DAG and DAF are utilized instead of DHG. Usually between about 5% and 35% by weight of high nitrogen coolant is present in the compositions of this invention. It has been found that DAF is compatible with isocyanate cure systems possibly because it is free of hydroxyl groups. DAF therefore offers greater flexibility in selection of binder systems for the propellants of this invention.

MODERATOR

Another ingredient which may be present is oxamide, which supplements and moderates the action of either the DAG or DAF.

FUEL

In addition to the perchlorate and the coolant(s) the propellant composition may contain a fuel. The fuel burned with the perchlorate oxidizer may be a free metal such as aluminum or magnesium or beryllium or their metal alloys. When a metallic fuel is present the composition should contain between 2% and 25% by weight of fuel.

The presence of a free metal in the composition in sufficient quantity produces much higher flame temperatures than those produced in otherwise similar compositions from which the metal is absent.

BINDER

As described, for example in the above noted patents, in addition to the oxidizer, coolant, fuel and moderator the compositions contain a binder which is usually a combustible polymeric resin. Resins which have been found to be suitable include those mentioned in U.S. Pat. No. 3,960,946. Preferred resins are carboxy terminated polybutadienes and hydroxy terminated polybutadienes. The amount of binder should be between 10% and 25% by weight of the composition.

OTHER INGREDIENTS

Other ingredients which may be present in the solid propellant compositions of this invention include carbon which may be present for the purpose of darkening the composition, plasticizers, wetting agents, curing agents and the like as is well known in the art.

The following are illustrative compositions and their properties:

TABLE 1

| Low $\pi_k$ CTPB/AP/DAG Propellant | DAG |
|---|---|
| Propellant | |
| Mix no. | PV2-179 |
| Binder, % | 19.75 |
| Carbon, % | 0.25 |
| Oxamide, % | 5.0 |
| DAG, % | 15.0 |
| AP, % | 60.0 |
| Theoretical | |
| Flame temperature, °F. | 2305 |
| Density, g/cc | 1.540 |
| $I_{sp}$lb-sec/lb | 201.4 |
| Mechanical properties, 77° F. | |
| $E_o$, psi | 574 |
| $\sigma_m$, psi | 160 |
| $\epsilon_m, \epsilon_R$, % | 56/56 |
| TE-T-617 motor data | |
| $\pi_k$, %/°F. | 0.306 |
| (pressure), psi | (1250) |
| $\pi_k$, %/°F. | 0.166 |
| (pressure), psi | (1500) |
| $\pi_k$, %/°F. | 0.114 |
| (pressure), psi | (1800) |

TABLE 2

COMPARISON OF DHG, DAG, AND DAF CONTAINING PROPELLANTS AT 35% LEVEL

| Mix No. PT | 943 | 945 | 955 |
|---|---|---|---|
| HC/ERL, % | 24.0 | 24.0 | 24.0 |
| Oxamide, % | 7.5 | 7.5 | 7.5 |
| DHG, % | 35.0 | — | — |
| DAF, % | — | 35.0 | — |
| DAG, % | — | — | 35.0 |
| AP, % | 33.5 | 33.5 | 33.5 |
| 200μ/18μ parts | 15/85 | 15/85 | 15/85 |
| Theoretical Flame temp, °F. | 1766 | 1903 | 1810 |
| Burn Rate | | | |
| $r_b$, 1000, in./sec | 0.085 | 0.035 | 0.035 |
| n | 0.42 | 0.53 | 0.63 |

TABLE 3

COMPARISON OF COOLANTS AT 15% LEVEL

| Mix No. PT- | 896 | 898 | 900 |
|---|---|---|---|
| HC/ERL, % | 19.73 | 19.73 | 19.73 |
| DAG, % | 15 | 0 | 0 |
| DAF, % | 0 | 15 | 0 |
| DHG, % | 0 | 0 | 15 |
| Oxamide, % | 5 | 5 | 5 |
| AP, % | 60 | 60 | 60 |
| 400μ/200μ | 15/85 | 15/85 | 15/85 |
| ρ, g/cc | 1.541 | 1.541 | 1.573 |
| $T_f$, °F. | 2307 | 2305 | 2489 |
| $I_{sp}$, sec | 202.5 | 202.7 | 201.7 |
| Ballistics | | | |
| $r_{1000}$, in./sec | 0.111 | 0.114 | 0.129 |
| n | −0.215 | −0.296 | +0.002 |

Accompanying the decline in burning rate when DAG or DAF is substituted for DHG is an interesting negative exponent which begins at pressures above 1000 psi. The magnitude of this negative exponent appears to be greater for DAG than for either DHG- or DAF-containing formulations. Useful design applications may arise due to this unusual pressure response of these formulations.

In a limited study, samples of a DAG-containing formulation were aged for approximately four weeks at 65° C. (150° F.). As indicated in Table 4, the propellant undergoes some post cure, but appears to be stable.

TABLE 4

AGING RESULTS OF DAG-CONTAINING PROPELLANT (PT-1012)

| | Aging at 150° F. | |
|---|---|---|
| | 0 time | 4 Weeks |
| E, psi | 654 | 889 |
| $\sigma_m$, psi | 155 | 149 |
| $\sigma_R$, psi | 152 | 146 |
| $\epsilon_m$, % | 30 | 24 |
| $\epsilon_R$, % | 32 | 25 |

Figure 4:
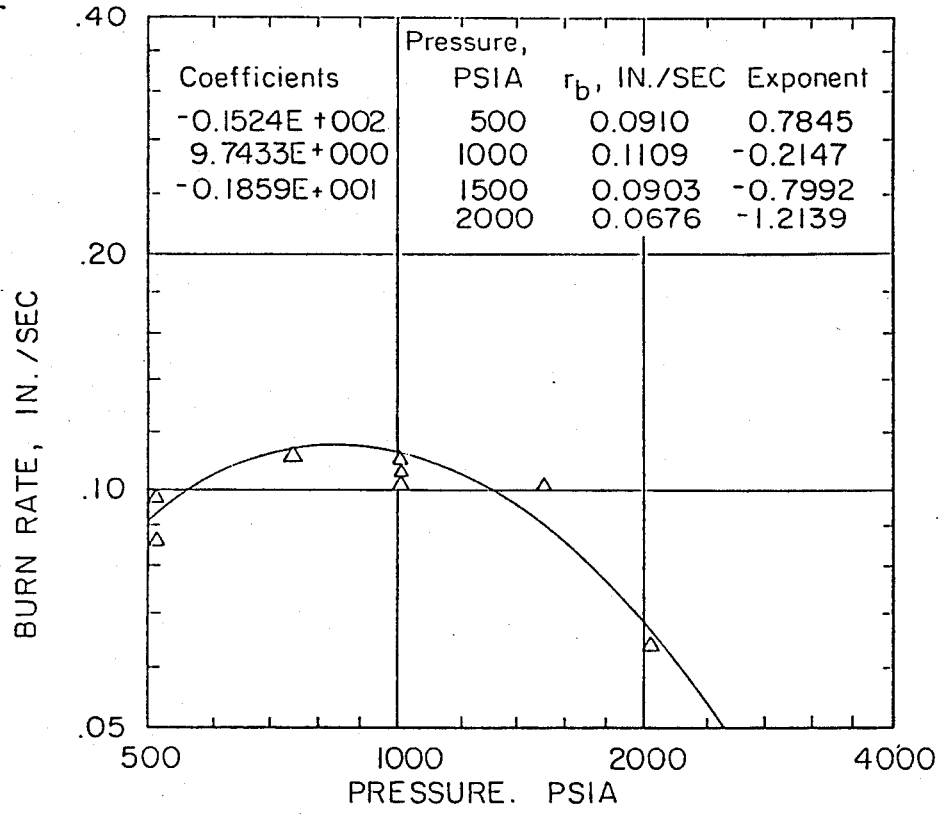
FIGS. 4, 5 and 6 are additional graphs showing the burn rate vs. pressure for other propellant compositions.
Figure 5:
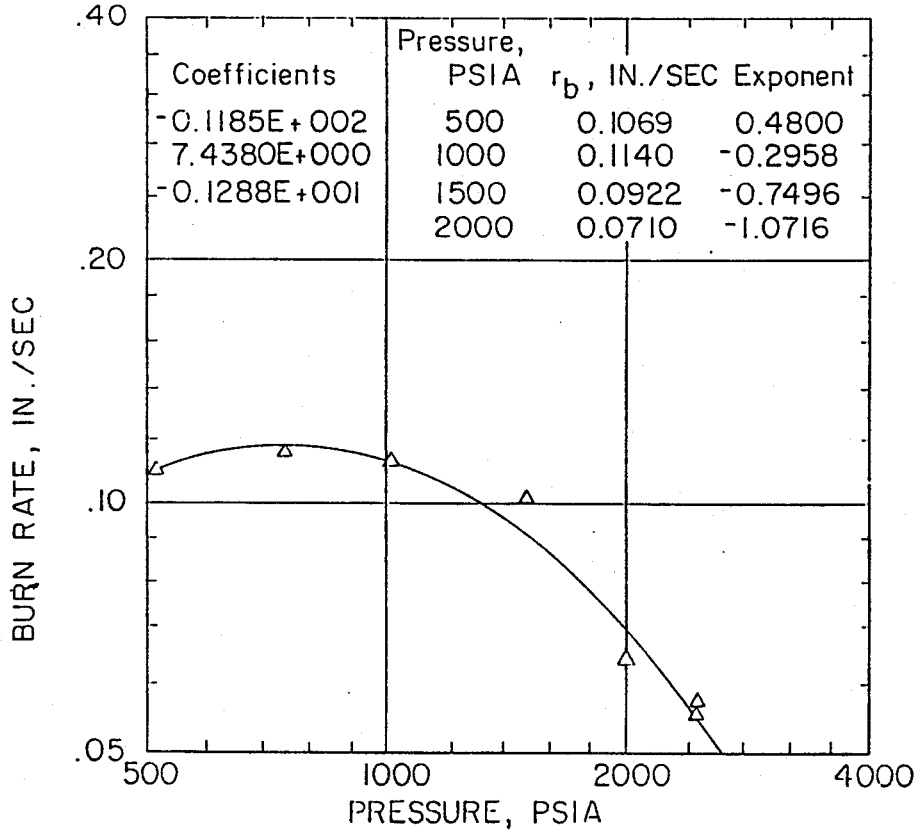
Figure 6:
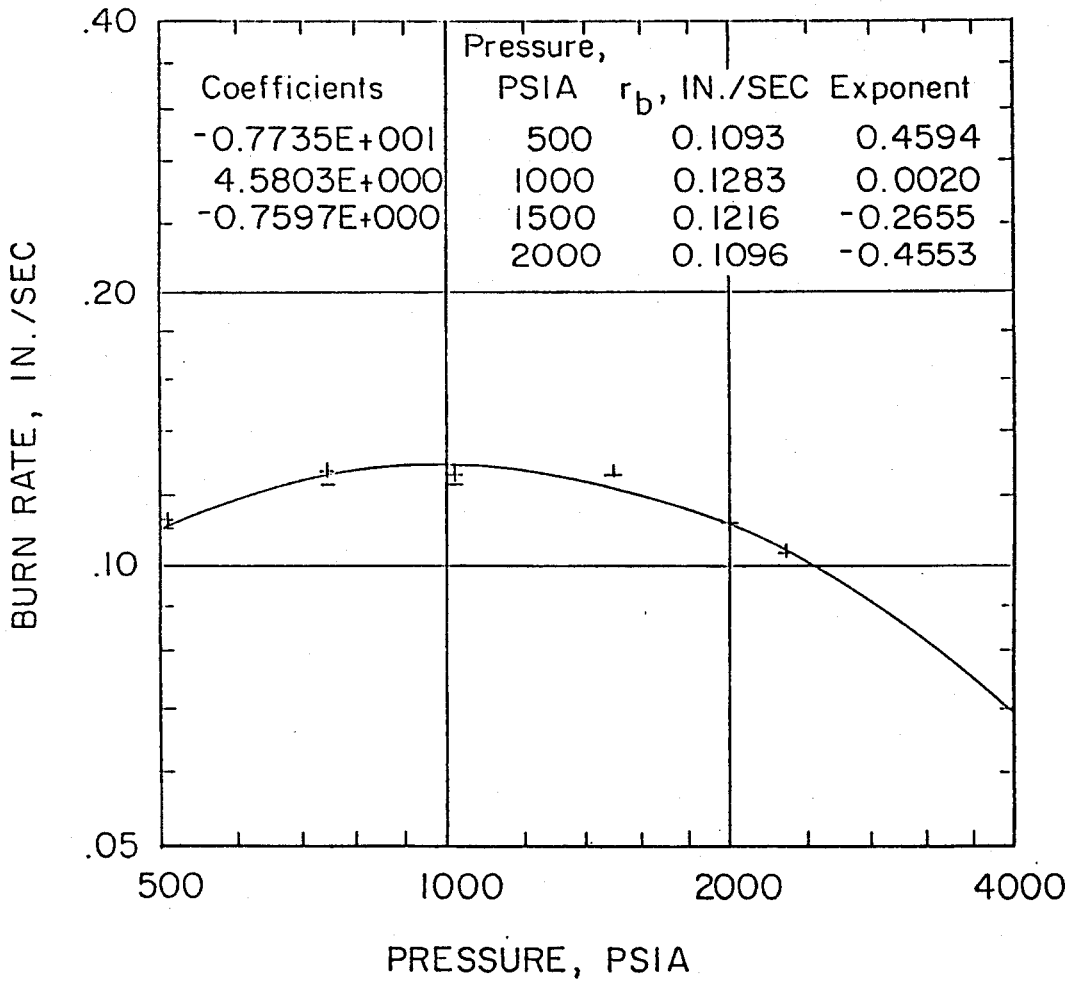

Both DAG and DAF appear to be viable coolant ingredients which offer interesting motor design possibilities due to the flat and negative pressure exponents that they exhibit below 3000 psi. Both ingredients, however, must be used at lower levels than DHG for a given gas generator application since they provide higher theoretical flame temperature and lower measured burn rates than a baseline DHG formulation at the same weight percent. FIGS. 4, 5 and 6 are graphs showing the burn rate vs. pressure for the propellants defined in Table 3 and further illustrate the flat and negative pressure exponents that they exhibit below 3000 psi.

The compositions of the invention are prepared in the same fashion as those in the above noted patents, i.e. by mixing the ingredients in a two-blade planetary mixer (Baker-Perkins), the order of addition being liquids first, then the solids, the curing agent being added last. Once the ingredients have been blended they are cast into the desired shape and cured.

While the previously described formulations without any free metal are quite satisfactory as gas generating compositions e.g. for use in turbines, it has been found that addition of either diaminoglyoxime or diaminofurazan to highly aluminized compositions propellant provides several benefits which make the compositions particularly useful for rocket motors. First, the burn rates of the propellants are reduced and a plateau occurs roughly between 1500 and 2500 psi, thus the burn rate pressure exponent is reduced in this region. Third, the $\pi_k$ (temperature sensitivity) of the propellants are lower. Also all of these benefits are obtained with little loss in specific impulse.

The effect of replacing 5% of the coarse ammonium perchlorate in one propellant mixture with diaminoglyoxime is illustrated in FIG. 1 and Table 5. The burn rate at 2000 psi has been reduced from 0.36"/sec to 0.28'/sec (22%) and the burn rate pressure exponent reduced from 0.31 to approximately 0.1. Table 5 below summarizes the theoretical performance of the two propellants.

TABLE 5

| | TP-H-3062 | TP-H-3062-5% DAG |
|---|---|---|
| HC (Binder) | 13.452 | 13.452 |
| MAPO (Cure) | 0.368 | 0.368 |
| ERL0510 (Cure) | 0.180 | 0.180 |
| Al | 16.000 | 1.000 |
| AP | 70.000 | 65.000 |
| DAG | — | 5.000 |
| Isp, sec | 263.3 | 261.6 |
| Density | 1.749 | 1.731 |

TABLE 5-continued

| | TP-H-3062 | TP-H-3062-5% DAG |
|---|---|---|
| O/F | 1.276 | 1.178 |
| $T_f$/°F. | 5662 | 5408 |

Figure 2:
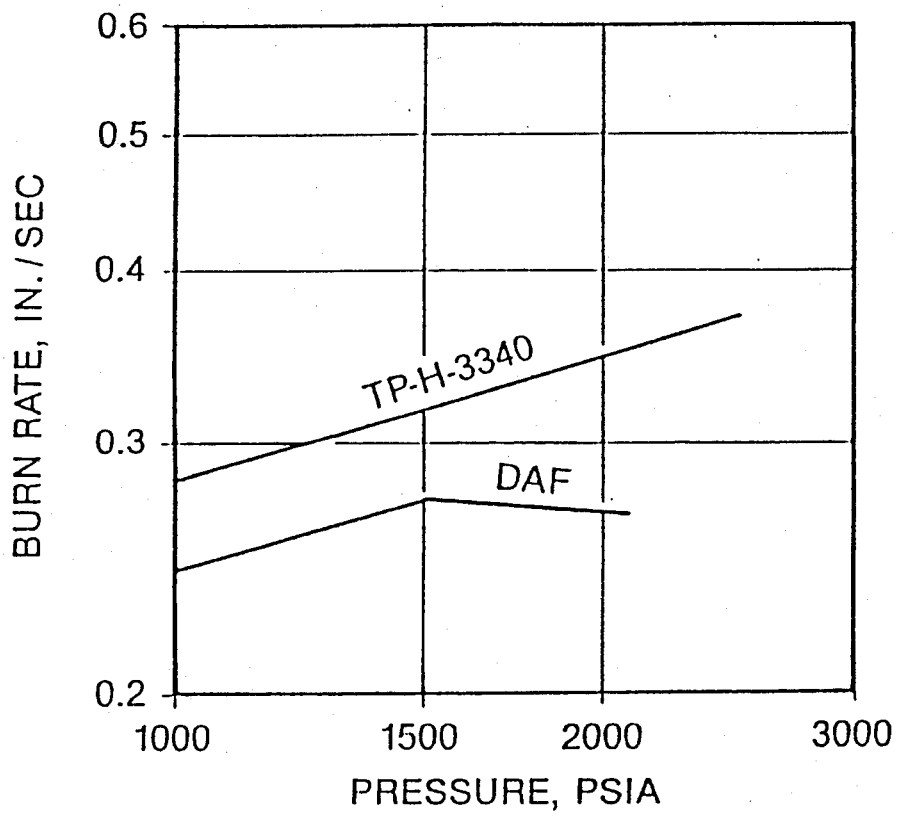
FIG. 2 is a similar graph for a similar propellant composition containing DAF.
Figure 3:
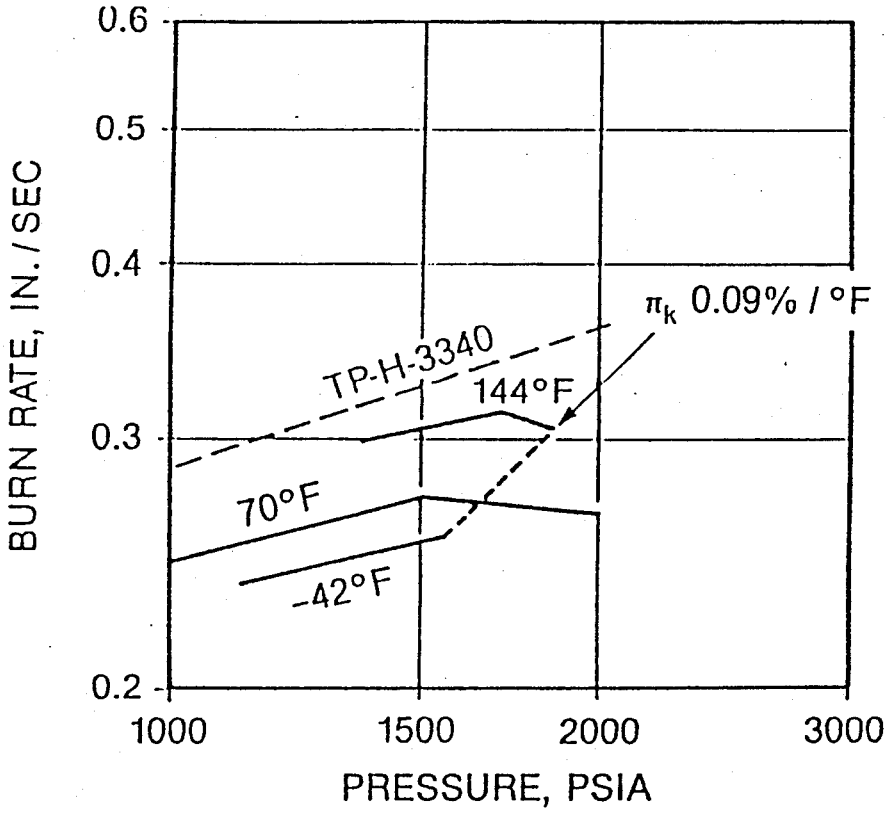
FIG. 3 is a similar graph showing the burn rate vs pressure, of a DAF containing propellant at various temperatures.

The effect of replacing 10% of the extra coarse AP in TP-H-3340 with diamino furazan is illustrated in FIG. 2 and FIG. 3.

The formula for TP-H-3340 is as follows:

| | % |
|---|---|
| R45M/IPDI (Binder) | 10.85 |
| HX-752 (Bonding Agent) | 0.15 |
| Al | 18.00 |
| AP 400 | about 42.00 |
| AP 200 | about 21.00 |
| AP 20 | about 7.00 |

The burning rate at 2000 psi is reduced from 0.35"/sec to 0.265"/sec (24%) and the exponent has been reduced from 0.31 to essentially 0.00. FIG. 3 summarizes the ballistic behavior of this propellant at −42, 70, and 144° F. The k for this propellant at 1700 psi is 0.09%/° F. which is 25% lower than the normal 0.12%/° F.. Table 6 summarizes the effect of addition of DAG, DAF, DHG, Oxamide and dicyandiamide (DCDA) on the theoretical performance of 88% and 90% total solids, 19% Al propellants. The smaller Isp penalty using DAG or DAF as compared to oxamide and DCDA is quite significant.

TABLE 6

Properties of Candidate HP Propellants

| | 88% Solids | | | | | |
|---|---|---|---|---|---|---|
| R45M, % Binder | 11.13 | | | | | |
| IDPI, % Cure | 0.87 | | | | | |
| Al, % | 19.00 | | | | | |
| AP, % | 59.00 | | | | | |
| Additive | AP | DAG | DAF | DHG | OXAMIDE | DCDA |
| % | 10.00 | 10.00 | 10.00 | 10.00 | 10.00 | 10.00 |
| p, g/cc | 1.799 | 1.762 | 1.762 | 1.790 | 1.771 | 1.736 |
| Isp, lbf-sec/lbm | 265.1 | 263.1 | 263.6 | 261.6 | 257.1 | 257.0 |
| O/F | 1.238 | 1.007 | 1.055 | 1.135 | 1.054 | 0.943 |

TABLE 6-continued

Properties of Candidate HP Propellants

| | 90% Solids | | | | | |
|---|---|---|---|---|---|---|
| R45M, % (Binder) | 9.13 | | | | | |
| IPDI, % (Cure) | 0.87 | | | | | |
| Al, % | 19.00 | | | | | |
| AP, % | 61.00 | | | | | |
| Additive | | DAG | DAF | DHG | OXAMIDE | DCDA |
| % | 10.00 | 10.00 | 10.00 | 10.00 | 10.00 | 10.00 |
| p, g/cc | 1.838 | 1.800 | 1.800 | 1.829 | 1.809 | 1.772 |
| Isp, lbf-sec/lbm | 264.9 | 264.5 | 264.3 | 261.4 | 258.2 | 261.7 |
| O/F | 1.377 | 1.115 | 1.168 | 1.255 | 1.164 | 1.044 |

TP-H-1202; O/F = 1.118 p = 1 1.842, Isp = 267.3 Isp at 1000/14.7 pressure ratio

Having now described preferred embodiments of the invention, it is not intended that it be limited except as may be required by the appended claims.

We claim:

1. A high solids propellant based on a perchlorate and containing a diamino compound selected from the group consisting diaminoglyoxime and diaminofurazan.

2. The propellant of claim 1 in which the perchlorate is ammonium perchlorate.

3. The propellant of claim 1 including a resin binder.

4. The propellant of claim 1 wherein the perchlorate comprises up to about 88% by weight of the propellant.

5. The propellant of claim 1 wherein the propellant contains between 2 and 25% by weight of a free metal.

6. The propellant of claim 5 wherein the free metal is selected from the group consisting of Al, Mg and Be.

7. The propellant of claim 1 in which the diamino compound is present in amount sufficient to substantially reduce the burn rate of the propellant.

8. The propellant of claim 3 wherein the resin binder is selected from carboxyterminated polybutadienes and hydroxyterminated polybutadienes.

9. A propellant composition for rocket motor engines comprising:

an oxidizer
a coolant
a moderator
and a binder, the oxidizer being a perchlorate; the coolant being diaminoglyoxime or diaminofurazan, the moderator being oxamide and the binder being a polybutadiene.

10. The propellant composition of claim 9 including in addition metallic Al.

* * * * *